US008485007B2

(12) United States Patent
Downes

(10) Patent No.: US 8,485,007 B2
(45) Date of Patent: Jul. 16, 2013

(54) KEY ORGANIZING DEVICE

(75) Inventor: Josh Downes, Henderson, NV (US)

(73) Assignee: Keypoint, Inc., Las Vegas, NV (US)

( * ) Notice: Subject to any disclaimer, the term of this patent is extended or adjusted under 35 U.S.C. 154(b) by 0 days.

(21) Appl. No.: 12/808,358

(22) PCT Filed: Dec. 15, 2008

(86) PCT No.: PCT/US2008/086896
§ 371 (c)(1),
(2), (4) Date: Jun. 15, 2010

(87) PCT Pub. No.: WO2009/079482
PCT Pub. Date: Jun. 25, 2009

(65) Prior Publication Data

US 2011/0016937 A1 Jan. 27, 2011

Related U.S. Application Data

(63) Continuation-in-part of application No. 12/442,098, filed as application No. PCT/US2007/078960 on Sep. 19, 2007, now Pat. No. 8,146,736.

(60) Provisional application No. 61/007,730, filed on Dec. 14, 2007, provisional application No. 60/845,887, filed on Sep. 19, 2006, provisional application No. 60/845,998, filed on Sep. 20, 2006.

(51) Int. Cl.
*A44B 15/00* (2006.01)
*A45C 11/32* (2006.01)
*A47G 29/10* (2006.01)

(52) U.S. Cl.
USPC ..... 70/456 R; 70/395; 70/408

(58) Field of Classification Search
USPC ..... 70/395, 408, 456 R; D8/347
See application file for complete search history.

(56) References Cited

U.S. PATENT DOCUMENTS 1,665,016 A 4/1928 Benham et al.
1,936,273 A 11/1933 Segal (Continued)

FOREIGN PATENT DOCUMENTS

EP 1 621 100 A2 2/2006
WO 9933370 7/1999

(Continued)

OTHER PUBLICATIONS

International Preliminary Report on Patentability dated Jun. 15, 2010, Written Opinion of the International Searching Authority dated May 18, 2009, and International Search Report dated May 18, 2009, for International PCT/US2008/086896, filed Dec. 15, 2008.

(Continued)

*Primary Examiner* — Suzanne Barrett
*Assistant Examiner* — David E Sosnowski
(74) *Attorney, Agent, or Firm* — Pearne & Gordon LLP

(57) ABSTRACT

An organizing device including housing, cover, and sliding mechanism. The housing includes a cavity, at least one open end and at least one sliding mechanism opening extending in the longitudinal direction along the housing for receiving and retaining at least part of the sliding mechanism within the housing. The cover is removeably attached over the open end of the housing. Sliding mechanism includes an actuation portion or thumb actuator and mounting portion for mounting a key or other user device. The mounting portion of the sliding mechanism is positioned inside cavity of the housing and the actuation portion of the sliding mechanism extends though the sliding mechanism opening in the housing. In one implementation, the mounting mechanism may be permanently or removeably fixed to the user device. In the case of a key, the mounting mechanism may be mounted to the key blade to form the modified key. The sliding mechanism is movable longitudinally along the housing to retract and extend the user device in and out of one end of the housing.

12 Claims, 13 Drawing Sheets

U.S. PATENT DOCUMENTS

| | | | | | |
|---|---|---|---|---|---|
| 1,996,933 | A | | 4/1935 | Segal | |
| 2,076,895 | A | | 4/1937 | Johnston | |
| 2,344,581 | A | * | 3/1944 | Ziegeweid | 70/456 R |
| 2,493,330 | A | | 1/1950 | Zimmerman | |
| 2,503,380 | A | | 4/1950 | Derby | |
| 2,541,333 | A | | 2/1951 | Campbell | |
| 2,558,265 | A | | 6/1951 | Mosch | |
| 2,560,595 | A | | 7/1951 | Poncar | |
| 2,575,424 | A | * | 11/1951 | Mitchell | 70/456 R |
| 2,605,632 | A | | 8/1952 | Lamonde | |
| 2,637,994 | A | * | 5/1953 | Harrison, Jr. et al. | 70/456 R |
| 2,640,347 | A | * | 6/1953 | Majeski | 70/456 R |
| 2,669,859 | A | * | 2/1954 | Hudson, Jr. | 70/456 R |
| 2,695,511 | A | | 11/1954 | Wing et al. | |
| 2,789,613 | A | | 4/1957 | Corsaw | |
| 2,790,319 | A | | 4/1957 | Brunner | |
| 3,004,422 | A | | 10/1961 | Starrett | |
| 3,137,157 | A | * | 6/1964 | Ralton | 70/456 R |
| 3,147,609 | A | | 9/1964 | Ryan | |
| 3,328,986 | A | * | 7/1967 | Ralton | 70/456 R |
| 3,349,589 | A | * | 10/1967 | Fricke | 70/395 |
| 3,354,678 | A | | 11/1967 | Stifelman | |
| 3,355,917 | A | * | 12/1967 | Albert | 70/456 R |
| 3,394,565 | A | * | 7/1968 | Turman | 70/414 |
| 3,407,636 | A | | 10/1968 | Kovacevic | |
| 3,421,349 | A | * | 1/1969 | Clair, Jr. | 70/414 |
| 3,427,834 | A | * | 2/1969 | Tutino | 70/414 |
| 3,457,746 | A | * | 7/1969 | Glassman | 70/456 R |
| 3,526,112 | A | * | 9/1970 | Herrington | 70/395 |
| 3,606,777 | A | | 9/1971 | Watson | |
| 3,618,346 | A | | 11/1971 | Humphrey | |
| 3,672,192 | A | * | 6/1972 | Dontas | 70/414 |
| 3,729,965 | A | | 5/1973 | Gartner | |
| 3,765,200 | A | * | 10/1973 | Vogt | 70/456 R |
| 3,780,550 | A | * | 12/1973 | Simorghi | 70/395 |
| 3,797,291 | A | * | 3/1974 | Simorghi | 70/395 |
| 3,813,907 | A | | 6/1974 | Jones, Jr. et al. | |
| 3,832,874 | A | | 9/1974 | Willis | |
| 3,950,973 | A | | 4/1976 | Grasnianski | |
| 4,006,613 | A | | 2/1977 | Zion | |
| 4,305,267 | A | * | 12/1981 | Nish et al. | 70/395 |
| 4,417,410 | A | | 11/1983 | Freedom | |
| 4,557,123 | A | * | 12/1985 | Marks et al. | 70/395 |
| 4,569,215 | A | | 2/1986 | McCarthy | |
| 4,601,185 | A | | 7/1986 | Sheldon | |
| 4,628,717 | A | * | 12/1986 | Blum | 70/456 R |
| 4,646,913 | A | | 3/1987 | Wing et al. | |
| 4,909,054 | A | | 3/1990 | Fox | |
| D307,863 | S | | 5/1990 | Boag | |
| 4,941,335 | A | | 7/1990 | Allen | |
| 4,951,489 | A | | 8/1990 | Proch | |
| 4,951,819 | A | | 8/1990 | Gebert | |
| 5,117,666 | A | * | 6/1992 | Keefer | 70/456 R |
| 5,123,579 | A | | 6/1992 | Sugiyama | |
| 5,215,190 | A | | 6/1993 | Hoffpauir, Jr. | |
| 5,228,563 | A | * | 7/1993 | Stringham | 206/38.1 |
| 5,232,086 | A | * | 8/1993 | Montanari | 206/37.2 |
| 5,355,702 | A | * | 10/1994 | Escribens | 70/395 |
| 5,383,345 | A | * | 1/1995 | Kallinger-Prskawetz-Jacobsen | 70/395 |
| 5,487,291 | A | * | 1/1996 | Voigt | 70/456 R |
| 5,495,942 | A | * | 3/1996 | Izhak | 206/372 |
| 5,544,510 | A | | 8/1996 | Botteon et al. | |
| 5,943,889 | A | * | 8/1999 | Chiu | 70/456 R |
| 6,016,676 | A | * | 1/2000 | McConnell | 70/408 |
| 6,035,679 | A | * | 3/2000 | Meroni | 70/396 |
| 6,092,405 | A | | 7/2000 | Berwick | |
| 6,196,036 | B1 | * | 3/2001 | Andersen | 70/408 |
| 6,237,756 | B1 | | 5/2001 | Caudle | |
| 6,314,775 | B2 | * | 11/2001 | Schwab | 70/456 R |
| 6,367,298 | B1 | | 4/2002 | Janssen et al. | |
| 6,371,286 | B1 | | 4/2002 | Montanari | |
| 6,427,504 | B1 | * | 8/2002 | Janssen et al. | 70/278.3 |
| 6,473,022 | B1 | * | 10/2002 | Wu | 341/176 |
| 6,604,308 | B1 | | 8/2003 | Robles | |
| 6,651,470 | B1 | * | 11/2003 | Rafter | 70/395 |
| 6,705,141 | B1 | * | 3/2004 | Jacob et al. | 70/408 |
| 6,755,061 | B2 | | 6/2004 | Herzenberg | |
| 6,763,692 | B1 | * | 7/2004 | Huang | 70/456 R |
| 6,763,938 | B1 | * | 7/2004 | Nelson | 206/37.1 |
| D499,323 | S | | 12/2004 | Smith | |
| 6,892,558 | B2 | | 5/2005 | Chodosh | |
| 6,928,845 | B2 | * | 8/2005 | Howard | 70/408 |
| 7,032,419 | B2 | * | 4/2006 | Booker | 70/456 R |
| 7,055,352 | B2 | * | 6/2006 | Meyerson et al. | 70/456 R |
| D530,186 | S | | 10/2006 | Johansson | |
| 7,127,922 | B2 | * | 10/2006 | Khounsombath et al. | 70/456 R |
| 7,360,383 | B1 | | 4/2008 | Chang | |
| D569,227 | S | | 5/2008 | Boenisch | |
| D592,935 | S | * | 5/2009 | Mesh et al. | D8/347 |
| D618,983 | S | | 7/2010 | Downes | |
| D624,305 | S | | 9/2010 | Downes | |
| 2001/0042392 | A1 | * | 11/2001 | Meynier | 70/408 |
| 2003/0167810 | A1 | * | 9/2003 | Frias et al. | 70/456 R |
| 2003/0172696 | A1 | | 9/2003 | Regina | |
| 2004/0055347 | A1 | | 3/2004 | Herzenberg | |
| 2004/0069661 | A1 | | 4/2004 | Telleen | |
| 2004/0148988 | A1 | * | 8/2004 | Taylor | 70/408 |
| 2005/0072198 | A1 | * | 4/2005 | Casellini et al. | 70/408 |
| 2005/0103070 | A1 | | 5/2005 | Meyerson et al. | |
| 2005/0103071 | A1 | | 5/2005 | Ng | |
| 2005/0199628 | A1 | | 9/2005 | Van Handel et al. | |
| 2005/0204789 | A1 | | 9/2005 | Brion Camean et al. | |
| 2005/0217327 | A1 | * | 10/2005 | Frias Frias et al. | 70/395 |
| 2006/0044109 | A1 | | 3/2006 | Griffits et al. | |
| 2006/0044116 | A1 | | 3/2006 | Mehler et al. | |
| 2006/0086163 | A1 | * | 4/2006 | Downes | 70/456 R |
| 2006/0090528 | A1 | * | 5/2006 | Moening | 70/395 |
| 2006/0144106 | A1 | * | 7/2006 | Beresnitzky | 70/456 R |
| 2007/0062229 | A1 | * | 3/2007 | Miyata et al. | 70/408 |
| 2007/0079639 | A1 | * | 4/2007 | Hsu | 70/456 R |
| 2010/0000885 | A1 | * | 1/2010 | Downes | 206/37.2 |
| 2011/0072870 | A1 | * | 3/2011 | Downes | 70/456 R |

FOREIGN PATENT DOCUMENTS

| | | | |
|---|---|---|---|
| WO | 03/082063 | A1 | 10/2003 |
| WO | 2007/050442 | A1 | 5/2007 |
| WO | 2008036783 | A1 | 3/2008 |
| WO | 2011038372 | A1 | 3/2011 |

OTHER PUBLICATIONS

International Preliminary Report on Patentability dated Apr. 23, 2008, Written Opinion of the International Searching Authority dated Feb. 16, 2007, and International Search Report dated Feb. 16, 2007, for International PCT/US2006/040972, filed Oct. 20, 2006.

International Preliminary Report on Patentability dated Mar. 24, 2009, Written Opinion of the International Searching Authority dated Dec. 8, 2008, and International Search Report dated Dec. 17, 2008, for International PCT/US2007/078960, filed Sep. 19, 2007.

International Search Report dated Feb. 17, 2011, for International PCT/US2010/050451, filed Sep. 27, 2010.

* cited by examiner

KEY ORGANIZING DEVICE

PRIORITY

This application claims the benefit of U.S. Provisional Application No. 61/007,730, filed on Dec. 14, 2007, and is a continuation-in-part of U.S. patent application Ser. No. 12/442,098 now U.S. Pat. No. 8,146,736, which was the National Stage of International Application No. PCT/US2007/078960, filed Sep. 19, 2007, which claims the benefit of U.S. Provisional Application No. 60/845,887, filed Sep. 19, 2006, and of U.S. Provisional Application No. 60/845,998, filed Sep. 20, 2006, of which U.S. Provisional Application No. 61/007,730, International Application No. PCT/US2007/078960, U.S. Provisional Application No. 60/845,887, and U.S. Provisional Application No. 60/845,998 are incorporated in their entirety by reference in this application.

BACKGROUND OF THE INVENTION

1. Field of the Invention

This invention generally relates to keys, and to devices for holding keys.

2. Related Art

Keys for locks have been ubiquitous for centuries. Many types of devices for holding keys have been developed that use rings, clips, chains, wallets, enclosures, and other structures to join keys together. In spite of all of the work that has been done to provide devices that organize keys for storage and convenient access, many people still tend to either mount their keys on a simple key ring, or use a wallet having rings for mounting keys. Both of these two types of key holding devices are generally perceived as disorganized and cumbersome. Meanwhile, keys generally have a chaotic variety of shapes and sizes, further contributing to the disorganization of a typical person's keys.

At a time where form and function have come together to propel personal convergent products to the forefront of consumerism, metal keys, key fobs, and key chains represent one of the last bastions of personal clutter. Most personal devices are getting smaller, lighter, faster, and stronger while key chains, key fobs, and remote alarms are becoming increasingly unwieldy.

A continuing need exists for standardized keys, and for a device for holding keys that facilitates organization of an end user's keys for secure storage and convenient use. Additionally, a need exists for a product that addresses the ongoing need for personal key organization, transport, and storage that infuses traditionally utilitarian function with personal style.

SUMMARY

An organization device is provided that is capable of housing a plurality of user devices, including, but not limited to, keys, key blanks, bottle openers, pens, knifes, nail files, laser pointers, whistles, USB storage devices, alarms, LEDs, radio frequency identification fobs, bar code fobs, vehicle operation communication devices or digital media players. In one implementation, the organizing device includes a housing having at least one sliding mechanism opening extending along the longitudinal direction of the housing. The organization device further has a cover removeably attached over one end of the housing and a sliding mechanism. The sliding mechanism may include an actuation device and mounting device. The mounting device may be integrated with the actuation device or may be a separate device that is removeably or permanently affixed to the key blade to form a modified key head. In either case, the mounting device of the sliding mechanism is positioned inside the housing and engages or is at least partially integrated with the user device. At least part of the actuation portion of the sliding mechanism extends through the sliding mechanism opening in the housing. In certain implementations, the sliding mechanism may be configured for attachment and detachment of the user devices to be contained within the housing, whereas in other implementations, at least a portion of the sliding mechanism is integrated with, or permanently affixed to, the user device. In an alternative implementation, the housing may include an engaging mechanism on at least one of its sides for permitting the engagement of a second housing member.

A key organizing device is also provided that houses a plurality of modified keys. The key organizing device may be constructed of a single housing or may be an expandable device, constructed from a number of separate key housings. The device may also be constructed to house items other than, or in addition to modified keys. In the key organizing device of the invention, the modified keys are engaged by a sliding mechanism (or slider) that permits the attachment of a modified head end of a key blade to a sliding mechanism. The sliding mechanism may include an actuation device and mounting device. The mounting device may be integrated with the actuation device or may be a separate device that is removeably or permanently affixed to the key blade to form the modified key head. The sliding mechanism moves longitudinally along the housing to permit the extension and retraction of the modified keys relative to the housing. Accordingly, the sliding mechanism allows the modified keys to be extended outward from the housing for use and retracted within, and protected by, the housing when not in use.

In one implementation, the housing may have two opposing ends, one end that is open for receiving interchangeable key assemblies comprised of sliding mechanisms and key blades to be held within the housing. A cover is provided to be placed over the open end. The other end is slotted for permitting the key assemblies contained in the housing to be extended (for use) and retracted (for storage) into and out of the housing. An optional housing sleeve may also be provided to protect the housing or provide additional aesthetic appeal.

In another implementation, the housing is constructed of a top and bottom piece having a closed end and an open end for receiving a slotted cover. In this example, the slotted cover may be removed from the housing to access the sliding mechanism and change the modified keys associated with each sliding mechanism positioning in the housing.

A key design is also provided that permits the use of the modified keys utilizing the key organization device of the invention to function as conventional keys. Crowns or other retaining mechanisms can be provided to engage the modified key blades of the modified keys, which modified key head may comprise the mounting device of the sliding mechanism.

In summary, an organization device is provided that consolidates user devices, and in one example, six keys, into a compact customizable device. The organization devices is designed to minimize the bulkiness and clatter of traditional key chains packed with keys of all sizes and to allow a user to easily access his or her keys without the need of search through a bulky set of keys to find a particular key. The customized keys or key blades with reduced sized key head for use in the connection with the organizing device may easily removed from the organization devices and further designed for use with snap-on heads or crowns that allow the customized keys to be retained by, or placed on, a traditional key chain.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION

As illustrated in FIGS. 1-36, key organizing devices, and modified keys for inclusion in such devices, are provided. In general, a key organizing device is provided that houses a plurality of keys having a modified key head ("modified key"). As will be further illustrated below, the device may be constructed of a single housing or may be an expandable device, constructed from a number of separate key housings. The device may also be constructed to house items other than, or in addition to modified keys.

In the illustrated examples, the modified keys are engaged by a sliding mechanism (or slider) that permits the key to slide longitudinally along the housing. The sliding mechanism may include an actuation mechanism and a mounting mechanism. As illustrated, the mounting mechanism of the sliding mechanism can be formed integral with the actuation mechanism, may be a separate piece that permanently or removeably fits on a modified key head or may be formed integral with the key blade to create the modified key head. In the case in which the mounting mechanism is formed integral with the key head, the mounting mechanism is designed to receive the actuation mechanism, which together allows for the key to slide longitudinally along the housing. In summary, the sliding mechanism, which may be formed of an integrated sliding mechanism or, an actuation device connected to a modified key head having a permanent or removeably attached mounting mechanism, permits the key blade to move longitudinally along the housing to permit the extension and retraction of the key blades relative to the housing. In this manner, the sliding mechanism allows the keys to be extended outward from the housing for use and retracted within, and protected by, the housing when in storage.

Figure 1:
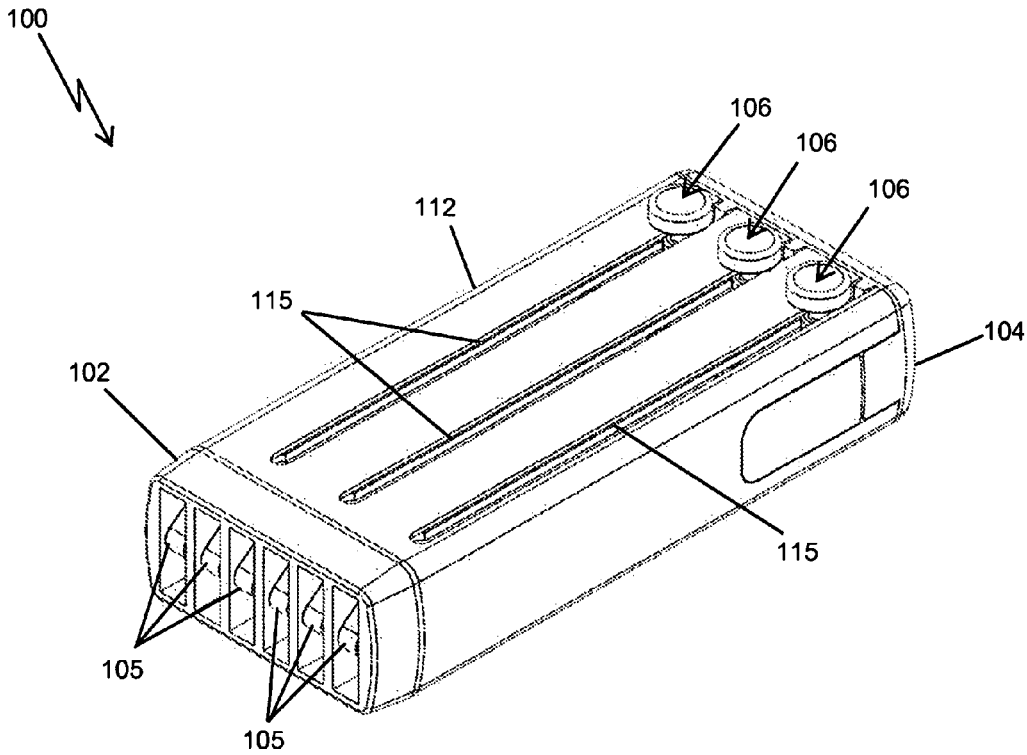
FIG. 1 is a perspective view showing an example of an implementation of a key organizing device.

FIG. 1 is a perspective view showing one example of an implementation of a key organizing device 100. The key organizing device 100 includes a housing 102, a cover 104 and multiple sliding mechanisms 106 capable of retaining key blades 105 in the housing 102 of the key organizing device 100. Sliding mechanism openings 115 extend along the housing 102 in the longitudinal direction for allowing the movement of the sliding mechanisms 106 along the housing in the longitudinal direction. In this manner, the sliding mechanisms 106 extend and retract the key blades 105 into and out of the housing 102. A sliding mechanism 106, together with a key blade 105, is referred to as a key assembly 802 (FIGS. 8-11). As further explained below, an optional housing sleeve 112 may also be utilized in connection with the key organizing device 100.

Figure 2:
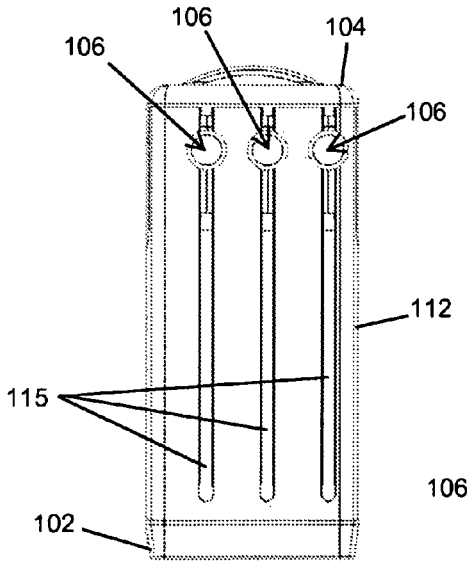
FIG. 2 is a top view of the key organizing device of FIG. 1.
Figure 3:
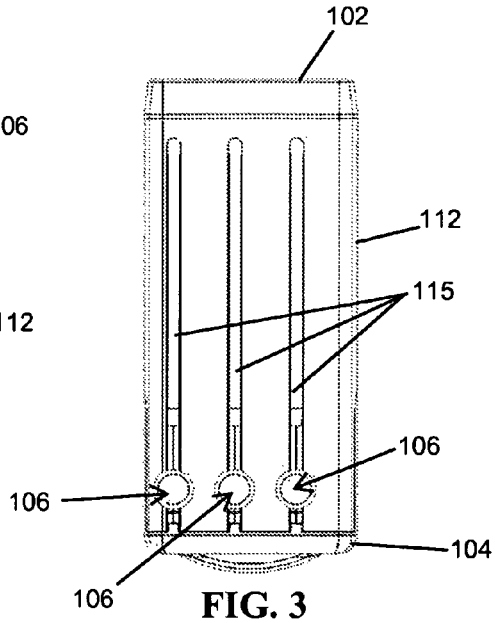
FIG. 3 is a bottom view of the key organizing device of FIG. 1

FIG. 2 is a top view of the key organizing device 100 of FIG. 1 and FIG. 3 is a bottom view of the key organizing device 100 of FIG. 1. As seen and described in connection with FIGS. 8-12 below, each sliding mechanism 106 includes an actuation portion or thumb actuator 806 and a mounting portion 808. The actuation portion 806 extends through sliding mechanism openings 115 to allow a user to move the key blade 105 along the housing 102, whereas, the mounting portion 808 is contained in the housing 102 and retains the head end of the key blade 105 or is formed integral with the key blade 105 to form a modified key head.

In the illustrated example, the key organizing device 100 includes six sliding mechanisms 106—three sliding mechanisms 106 of which are positioned such that the actuation portion 108 of the sliding mechanisms 106 extends from the top side of the key organizing device 100 for engagement by the user and three sliding mechanisms 106 of which are positioned such that the actuation portion 108 of the sliding mechanisms 106 extends from the bottom side of the key organizing device 100 for engagement by the user. To avoid user interference with neighboring sliding mechanisms 106 and maximize space, the sliding mechanisms 106 may be alternatingly positioned on opposite sides of the key organizing device 100. Those skilled in the art may, however, recognize that the sliding mechanisms 106 may be positioned such that all the sliding mechanisms 106 are on only one side of the key organizing device 100 or may alternate positions along the top and bottom sides of the key organizing device 100 in a different pattern than illustrated. Further, although the key organization device 100 illustrates the use of six key assemblies 802, the key organizing device 100 may be designed to contain one or more key assemblies 802, including, but not limited to six key assemblies 802. For example, in one alternative implementation, each key organizing device 100 may house only one key assembly 802; however, each key organizing device 100 may be designed to allow the attachment of another key organizing device 100 to one or more of its sides. Thus, the key organizing device 100 may be designed to be an expandable device 100 allowing for the expansion of the device 100 by adding or removing other key organizing devices 100 in a similar manner as illustrated in FIGS. 25-31 below.

Figure 4:
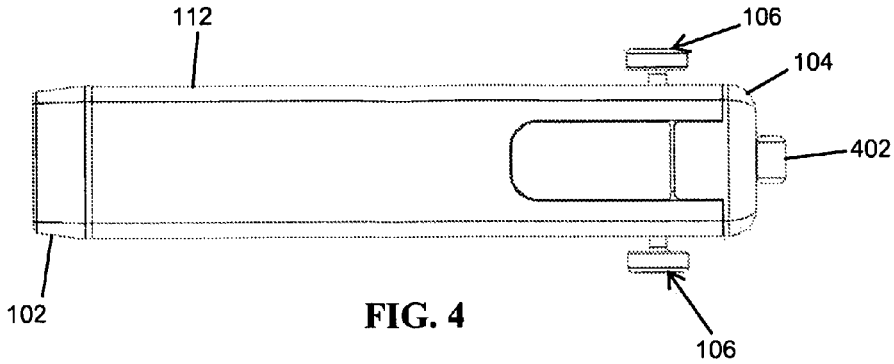
FIG. 4 is a side view of the key organizing device of FIG. 1.

FIG. 4 is a side view of the key organizing device 100 of FIG. 1. FIG. 4 illustrates that the sliding mechanisms 106 may be positioned on opposing top and bottom sides of the key housing organizer 100. As previously stated, positioning the sliding mechanisms 106 in this manner may help maximize space, as well as assist in ease in actuation of the sliding mechanisms 106 by a user with minimal interference or contact with the actuation portions 806 of the neighboring sliding mechanisms 106. Also illustrated in FIG. 4 is a projection 402 having an opening formed as a part of the cover 104. This projection 402 having an opening may be positioned at the back side of the key organizing device 100 and may be utilized to tether the key organizing device 100 to other devices or retaining mechanisms.

Figure 5:
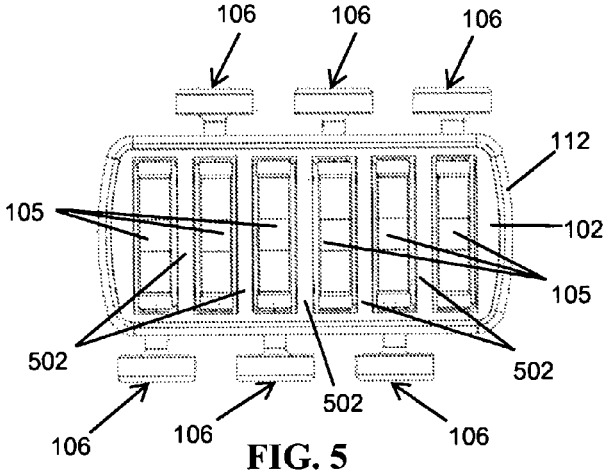
FIG. 5 is a front view of the key organizing device of FIG. 1.

FIG. 5 is a front view of the key organizing device 100 of FIG. 1. As illustrated by FIG. 5, the housing 102 of the key organizing device 100, at one end, as slotted openings for allowing the key blades 105 to extended from the housing 102. Each slot is separated by a wall member 502. The wall members 502 assist in guiding the movement of the key blades 105 into and out of the housing 102 of the key organizing device 100. Although not shown, the wall members 502 may run all or a portion of the longitudinal length of the interior of the housing 102 to guide the key blades 105 in and out of the housing 102 and to keep the key assemblies 802 separated and protected from contact with one another.

Figure 6:
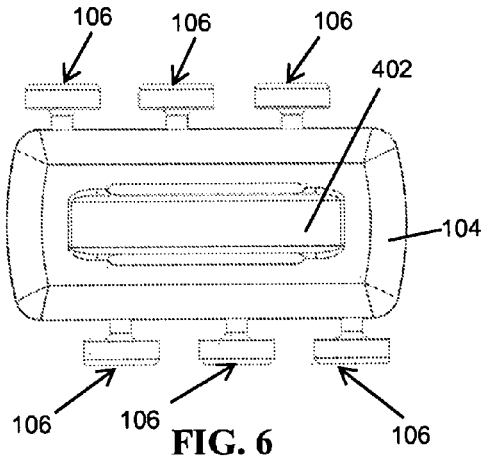
FIG. 6 is a rear view of the key organizing device of FIG. 1.

FIG. 6 is a rear view of the key organizing device 100 of FIG. 1. FIG. 6 best illustrates the alternating position of the sliding mechanisms 106 and conversely key assemblies 802 along the top and bottom sides of the key housing organizer 100. While this alternating pattern may be desirable to maximize space and minimize contact with neighboring sliding mechanisms 106 during operation, it is recognized that other spacing patterns are permissible. Further, all the sliding mechanisms 106 may be positioned on only one side of the key organizing device 100.

Figure 7:
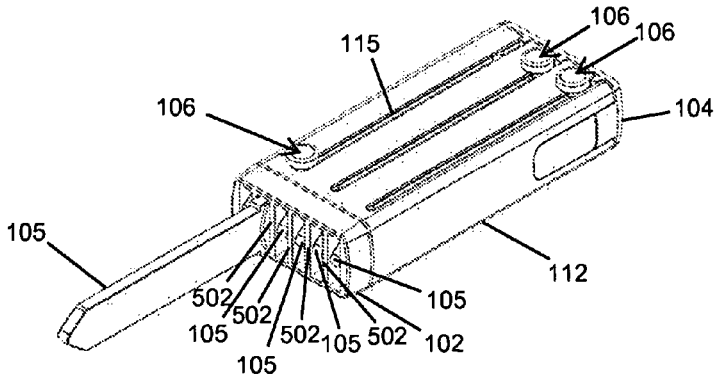
FIG. 7 is a perspective view of the key organizing device of FIG. 1 showing one key extending outside of the housing.

FIG. 7 is a perspective view of the key organizing device 100 of FIG. 1 showing one key blade 105 extending outside of the housing 102. As illustrated in FIG. 7, the sliding mechanism 106 on the far top side of the key organizing device 100 is slid longitudinally forward so that the sliding mechanism 106 is positioned near the front of the key organizing device 100, thereby pushing the key blade 105 forward and extending the key blade 105 outside of the housing 102 for use. As illustrated in FIG. 7, the slotted openings positioned on the front end of the housing 102 divided by the wall members 502, retain the key blades 105 and key assemblies 802 separated within the housing 102 and act as a guide for the key blades 105 when moving the key blades 105 from a retracted to an extended position. The width of the ports or slots in the device may be modified as necessary for a particular application, for example, the width of the slots may be increased to accommodate the wider auto and high security keys.

Figure 8:
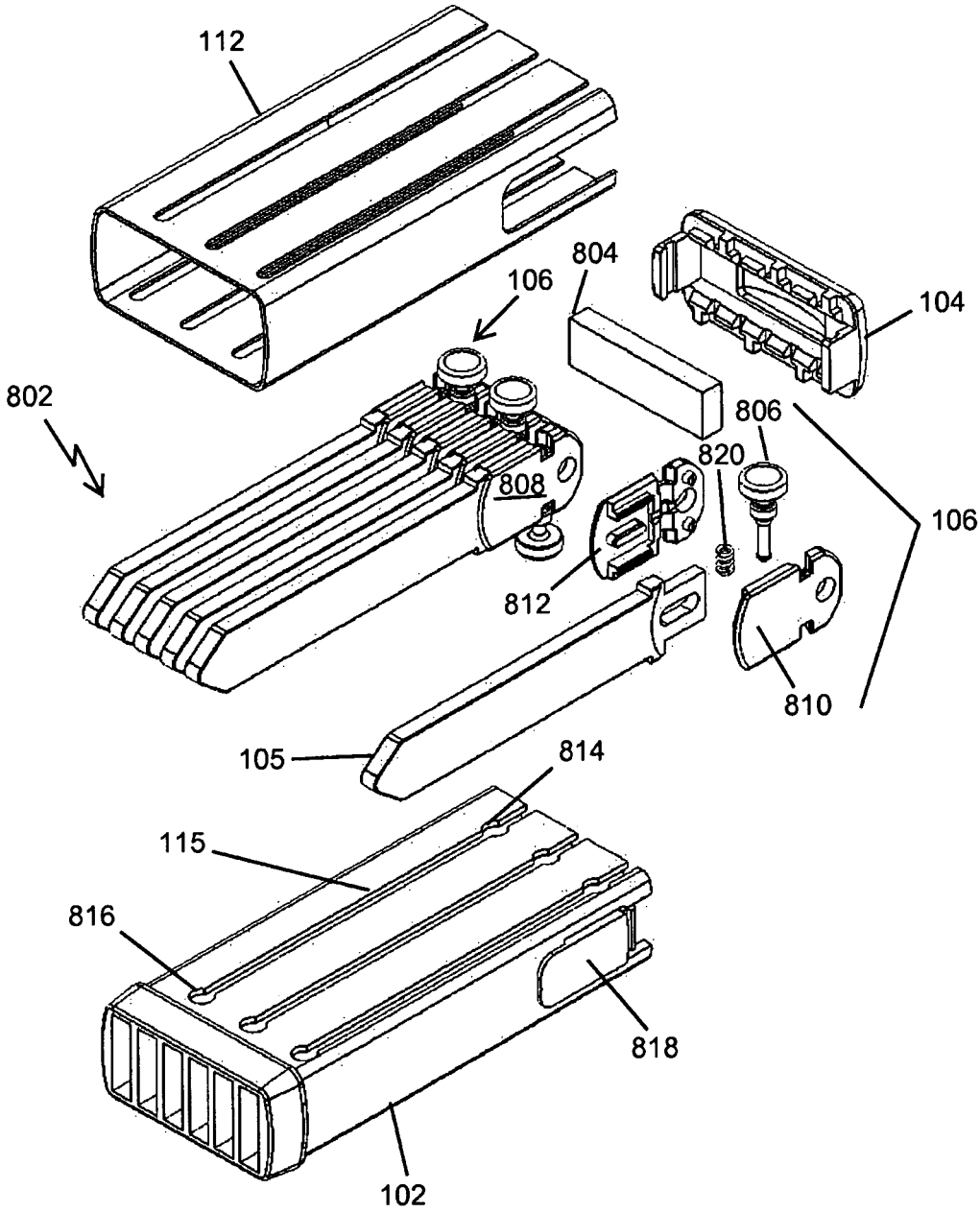
FIG. 8 is an exploded view of the key organizing device of FIG. 1.

FIG. 8 is an exploded view of the key organizing device 100 of FIG. 1. As illustrated, the key organizing device 100 includes a housing 102, cover 104, and a plurality of key assemblies 802. Optionally, the key organizing device 100 may further include a housing sleeve 112 that may be permanently or removeably affixed to the housing 102 to protect the housing 102 and provide added aesthetic value to the key organizing device 100. Additionally, a damper 804 may optionally be utilized to limit the movement of the key assemblies 802 in the housing 102 when retracted and to muffle any sound created by movement of the key assemblies 802 in the housing 102.

In the illustrated example, six key assemblies 802 are contained within the housing 102 of the key organizing device 100. The key assemblies 802 are positioned in alternative opposing relationships to one another such that every neighboring key assembly 802 is positioned in an opposing direction. The key assemblies 802 are contained in slotted openings within the housing 102 that are separated by wall members 502 to guide the key blades 105 in the longitudinal direction along the housing 102. Each key assembly 802 is constructed of a sliding mechanism 106 having an actuation device or thumb actuator 806 and a mounting device 808. In this example, the actuation device 806 is a spring-loaded pin assembly having a head 1005 (FIG. 10) for engaging the sliding mechanism 106. The mounting device 808 is constructed of two opposing side retaining plates 810, 812 for retaining both the key blade 105 and the actuation device 806, as will be further explained in connection with FIGS. 9-12.

The housing 102 may have two opposing tabs 818 spaced-apart and together forming a bezel configured for engaging the cover 104 for removable attachment of the cover 104 over the open end of the housing 102. For example, the tabs 818 may be configured to have hook ends having slots for engagement with projections or teeth extending from tabs positioned on opposing sides of the cover 104. The hook end of the tabs 818 may be disengaged from the tabs on the side slots of the housing 102, by squeezing the tabs 818. Those skilled in the art will recognize that other ways of removable attaching the cover may further be utilized. Additionally, in this example, to prevent the unwanted removal of the cover 104 (for example when the key organizing device is dropped), the tabs 818 may only be able to move inward and release the cover 104 when the modified keys in the end positions are at least partially extended, moving the key heads or sliding mechanisms downward and thereby eliminating interference with the ability to depress the tabs 818 inward.

Figure 9:
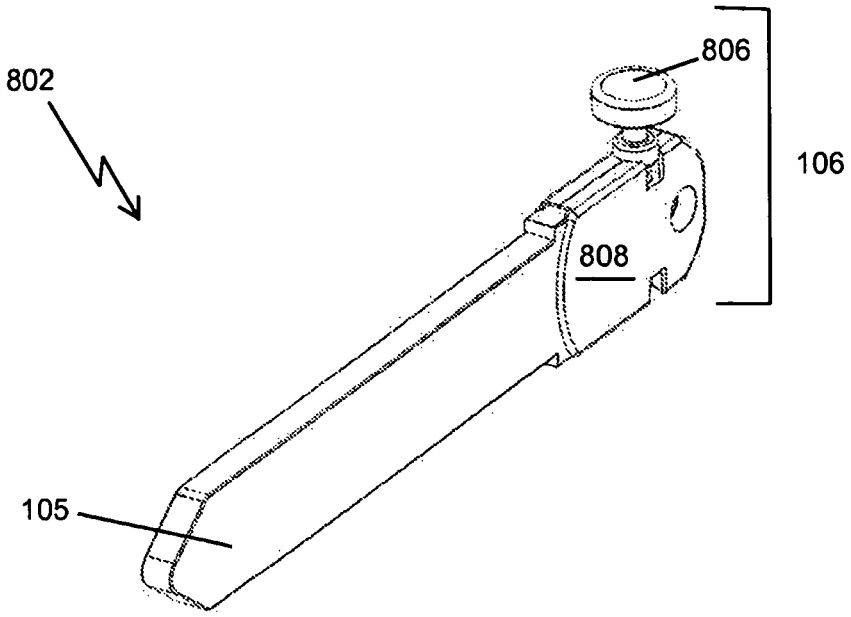
FIG. 9 is a perspective view of a key assembly utilized with the key organizing device of FIG. 1.
Figure 10:
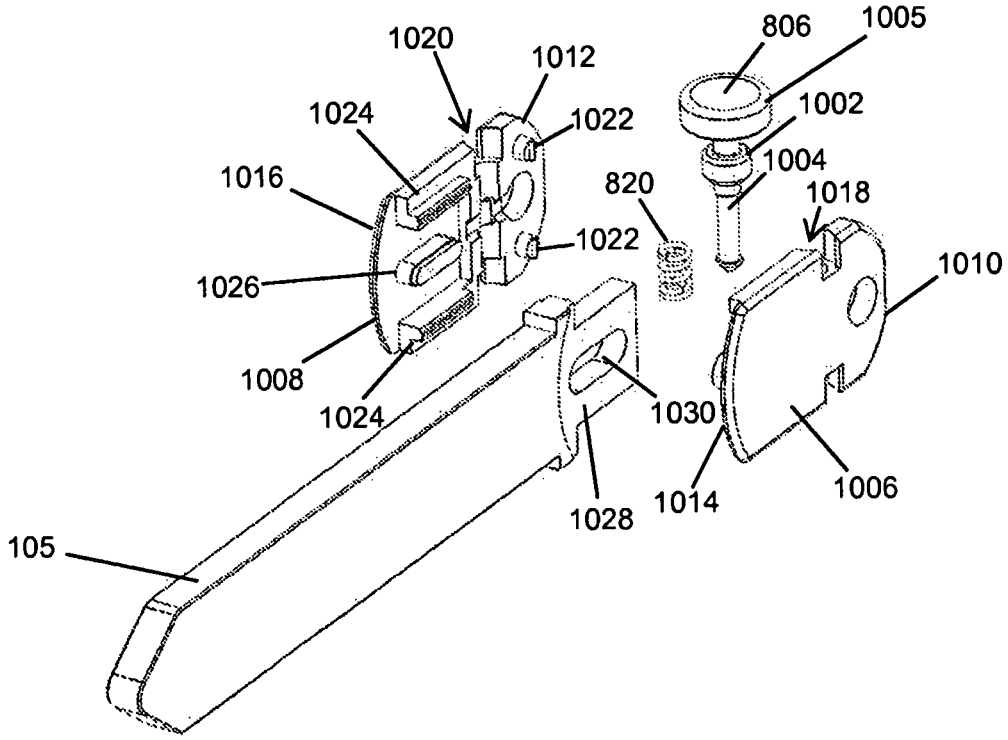
FIG. 10 is an exploded view of the key assembly of FIG. 9.

FIG. 9 is a perspective view of a key assembly 802 utilized with the key organizing device 100 of FIG. 1 and FIG. 10 is an exploded view of the key assembly 802 of FIG. 9. As illustrated, in this example key assembly 802, the key assembly 802 includes a sliding mechanism 106, having an actuation device 806 and a retaining device 808, as well as a key blade 105. The actuation device 806 of the sliding mechanism includes a spring-loaded pin assembly 806 constructed from a pin 1004 having a head 1005. The pin assembly further includes a stop mechanism 1002 positioned along the pin 1004 at a predetermined distance under the head 1005.

In the example, the mounting device 808 includes two opposing side retaining plates 1006, 1008. Each side retaining plate 1006, 1008 has a front portion 1010, 1012 and a back portion 1014, 1016, separated by a recess 1018, 1020 for retaining the spring-loaded pin assembly or actuation device 806, which is the pin 1004 and the spring 820 portions of the assembly. The retaining plates 1006, 1008 may be removeably or permanently affixed to one another to retain both the spring loaded pin assembly 806 and the key blade 105.

As illustrated, the key blade 105 includes a modified key head assembly 1028 that is generally of the same height of the key blade, but of slightly less thickness than the key blade for permitting the key head to fit snugly between the opposing retaining side plate 1006, 1008 of the sliding mechanism 106 when assembled. Thus, when assembled, the thickness of the mounting portion of the sliding mechanism is the same as or, as illustrated, greater than the width of the key blade. Such modified key head assembly 1028 further includes a hole or slot 1030 for engaging with a projection or locking mechanism 1026 in the mounting portion of the sliding mechanism 106. Such keys with modified key head assemblies 1028 may be included with, or sold separate from, the key organizing devices of the invention.

Figure 20:
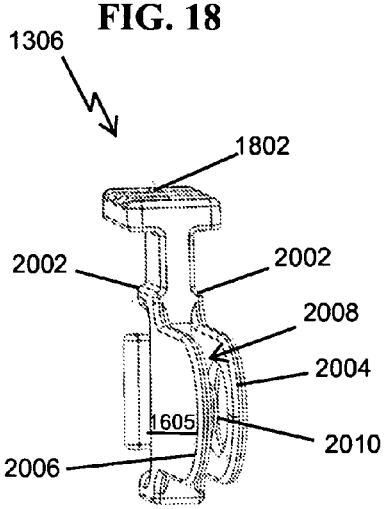
FIG. 20 is perspective view of the sliding mechanism of the key assembly showing in FIG. 19.
Figure 21:
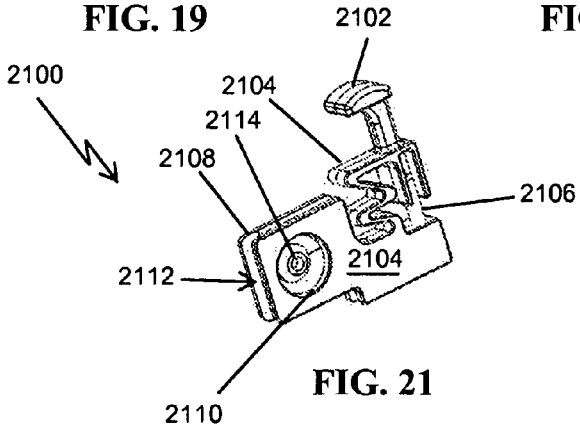
FIG. 21 is a perspective view of another example of sliding mechanism that may be utilized in a key assembly.
Figure 22:
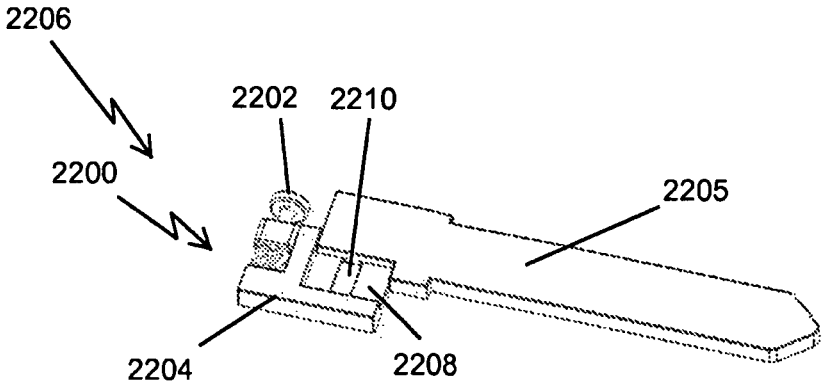
FIG. 22 is a perspective view of another example of a key assembly that may utilized in connection with a key organizer of the invention.

As previously discussed, the mounting mechanism 808 of the sliding mechanism 106 may be permanently or removeably affixed to the key blade 105. The mounting mechanism 808 can be formed integral with the actuation mechanism (as shown in FIGS. 20-22), or (as shown in the FIGS. 8-10) may be a separate piece that permanently or removeably fits on a modified key head or may be formed integral with the key blade 105 to create the modified key head (not shown). In the case in which the mounting mechanism 808 is formed integral with the key blade 105, the mounting mechanism 808 is designed to receive the actuation mechanism 806, which together allow for the key to slide longitudinally along the housing. The sliding mechanism or slider may then be formed only of an actuation device or mechanism 806 that is capable of connecting to a modified key head having a permanent or removeably attached mounting device or mechanism 808.

Figure 11:
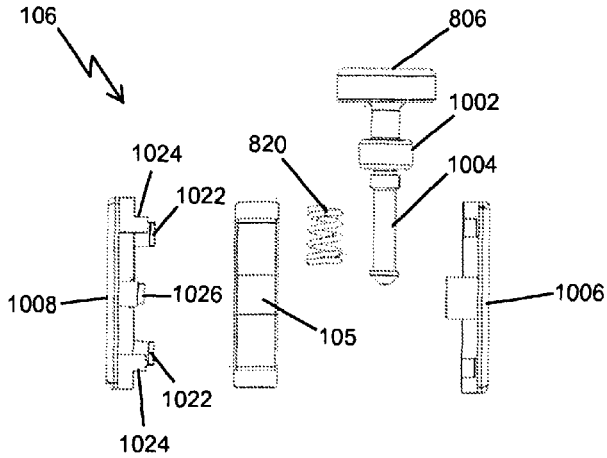
FIG. 11 is a rear view of the exploded key assembly of FIG. 10.
Figure 12A:
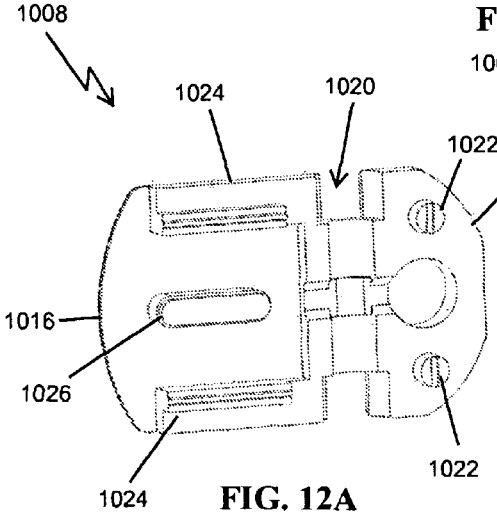
FIG. 12A is a first retaining member of the two opposing retaining members of the sliding mechanism of the key assembly illustrated in FIG. 9.
Figure 12B:
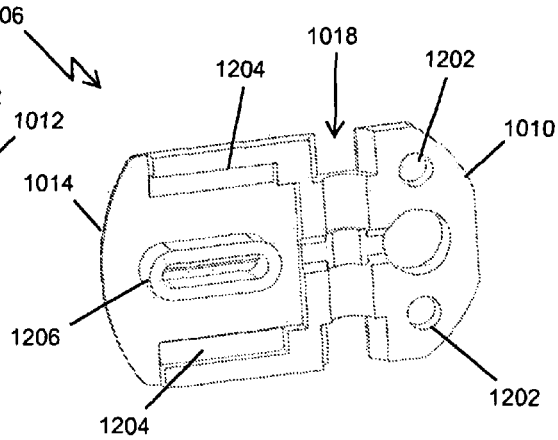
FIG. 12B is a second retaining member of the two opposing retaining members of the sliding mechanism of the key assembly illustrated in FIG. 9.

The operation and assembly of the retaining plates may be better understood with reference to FIGS. 11, 12A & 12B. FIG. 11 is a rear view of the exploded key assembly 802 of FIG. 10. FIGS. 12A & B illustrate examples of two opposing first and second side retaining plates 1006, 1008 of the sliding mechanism 106 of the key assembly 802. In the illustrated example, the interior sides of the side retaining plates 1006, 1008 face one another when the sliding mechanism 106 is assembled. The interior sides include corresponding male and female engagement members 1022, 1024 and 1202, 1204 on both the front and back portions 1010, 1012 and 1014 and 1016 of the side retaining plates 1006 and 1008 for alignment and engagement with one another through a locking or snap lock friction fit, or through welding procedures, including, but not limited to, ultrasonic welding. Alternatively, the side retaining plates 1006, 1008 may be designed integral with the key blade 105. Further, aligning projections 1026 and 1206 are also provided on the central portions of each of the side retaining plates 1006, 1008 for engaging the key blade 105 though a modified key head assembly 1028 (FIG. 10) having a hole 1030 positioned therein. The aligning projections 1026 and 1206 include male and female parts for engaging one another through the hole 1030 in the modified key head assembly 1028 such that the key blade 105 is held securely between the two opposing side retaining plates 1006, 1008 of the sliding mechanism 106.

When assembled, the stop mechanism 1002 of the pin assembly 806 extends just over the top edges of the opposing retaining side plates 1006, 1008. This allows the stop mechanism 1002, when the pin assembly 806 is in a resting position, to rest within the holes 814, 816 of the sliding mechanism openings 115, thereby retaining the position of the sliding mechanism 106 and key blade 105 in either a fully retracted or fully extended position. When the head 1005 of the pin assembly 806 is depressed, the stop mechanism 1002 is lowered at, or below, the top edge of the opposing side retaining plates 1006, 1008, which disengages the pin assembly 806 from the housing 102 and allows the key assembly 802 to slide longitudinally along the housing 102 in both directions.

Figure 13:
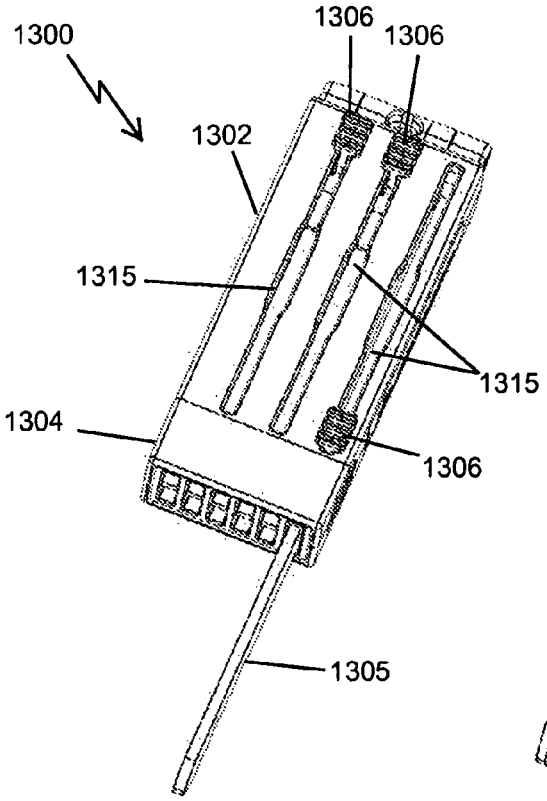
FIG. 13 is a top perspective view showing another example of an implementation of a key organizing device.

FIG. 13 is a perspective view of another example of an implementation of a key organizing device 1300. The key organizing device 1300 includes a housing 1302, a cover 1304, and a sliding mechanism 1306. The housing 1302 includes a cavity for receiving the sliding mechanisms 1306 and keys 1306. Sliding mechanism openings 1312 extend along the housing 1302 in the longitudinal direction. A cover 1314 is provided for removable attachment over the open end of the housing 1302.

As will be further illustrated below, in connection with FIGS. 18-21, the sliding mechanism 1306 includes an actuation portion or thumb actuator 1802 and mounting portion or key mount 1804. When assembled, the key mount 1804 is positioned inside the cavity of the housing 1302 and connected to the thumb actuator 1802 through the sliding mechanism opening 1315. Further, when assembled, the sliding mechanism 1306 is configured for attachment and detachment of a key blade 1305 through the open end of the housing 1302 upon removal of the cover 1304.

Figure 14:
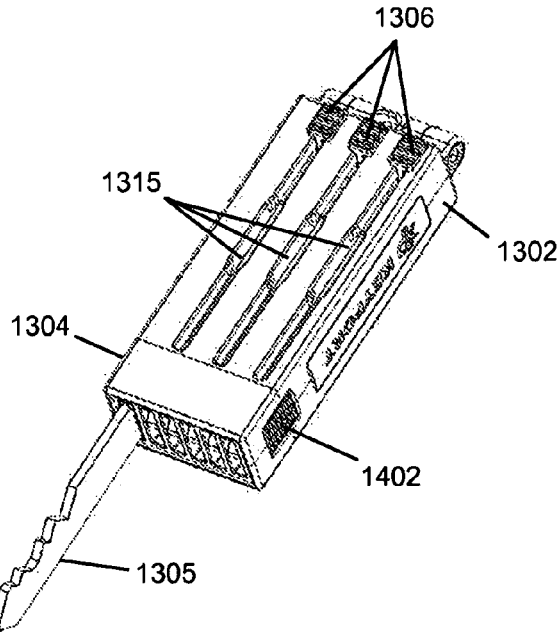
FIG. 14 is a bottom perspective view of the key organizing device shown in FIG. 13.
Figure 15:
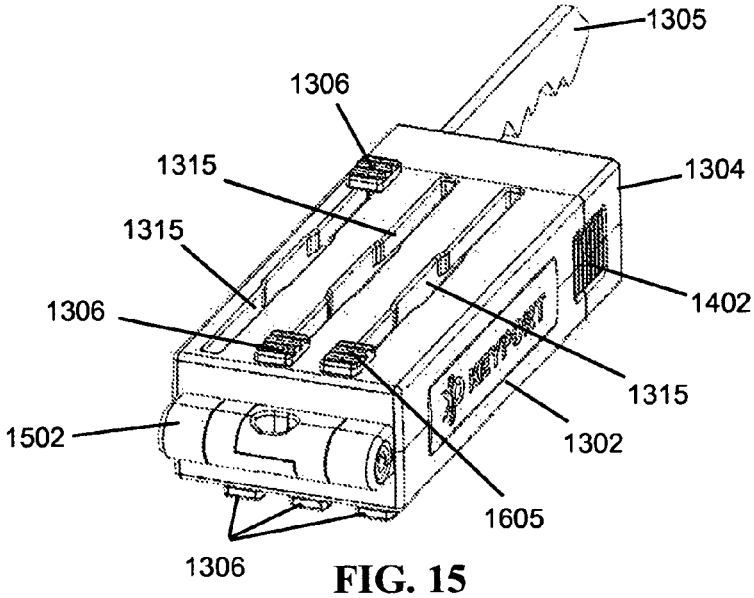
FIG. 15 is a rear perspective view of the key organizing device shown in FIG. 13.

FIG. 14 is a bottom perspective view of the key organizing device shown in FIG. 13 and FIG. 15 is a rear perspective view of the key organizing device shown in FIG. 13. As illustrated, the housing 1302 of the key organizing device 1300 further includes a closed back and a plurality of sliding mechanism openings 1315. The opposing ends of the housing 1302 are spaced apart in a longitudinal direction. The end of the housing 1302 where the cover 1304 is affixed, is open to permit keys to be extended from the housing 1302 through the cover 1304. A projection 1306 having a opening may be positioned at the closed end of the housing 1302 for tethering the key organizing device 1300 to another device or retaining mechanism.

Figure 16:
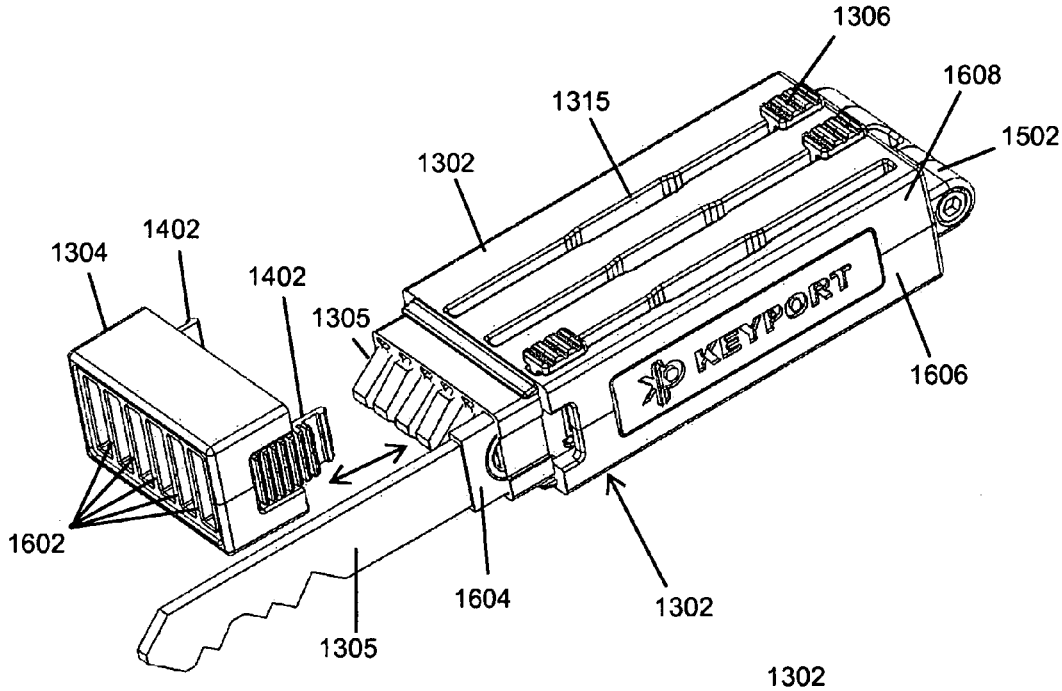
FIG. 16 is a further perspective view of the key organizing device shown in FIG. 13 illustrating the cover removed.

FIG. 16 is a further perspective view of the key organizing device shown in FIG. 13 illustrating the cover 1608 of the housing 1302 removed. The key organizing device 1300 may, as shown in the illustrated example, include a top portion or half 1608 and a bottom portion or half 1606 which may be secured or snapped together to form the housing 1308 or may be hinged together at the closed end of the housing 1308 forming the projection 1306. FIG. 16 further shows a plurality of key blades 1305 mounted in the key organizing device 1300, as well as one sliding mechanism 1306 positioned in the fully extended forward position, fully exposing the key and a portion of the mounting mechanism 1604 of the sliding mechanism 1306. In this position, the sliding mechanism 1306 is configured for attachment and detachment of a key blade 1305 through the end opening of the housing 1302 upon removal of the cover 1304.

The cover 1304 includes key slots separated by slot walls 1602 in mutual alignment with the key slots defined between the housing walls 1704 (FIG. 17) in the housing 1302 of key organizing device 1300. The cover 1304 may be attached over, or removed from, key blades 1305 at the open end of the housing 1302 in the directions of the arrows. The cover 104 may have two opposing tabs 1402 spaced-apart and together forming a bezel configured for engaging the housing 1302 for removable attachment of the cover 1304 over the open end of the housing 1302. For example, the tabs 1402 may be configured for insertion into slots on the opposing sides of the housing 1302. The tabs 1402 may include hooks for engaging hooks on the receiving slots in the sides of the housing 1302. The tabs 2002 may have friction plates for gripping the cover 1304. The hooks may be disengaged from the hooks on the side slots of the housing 1302, by squeezing the tabs 1402.

Figure 17:
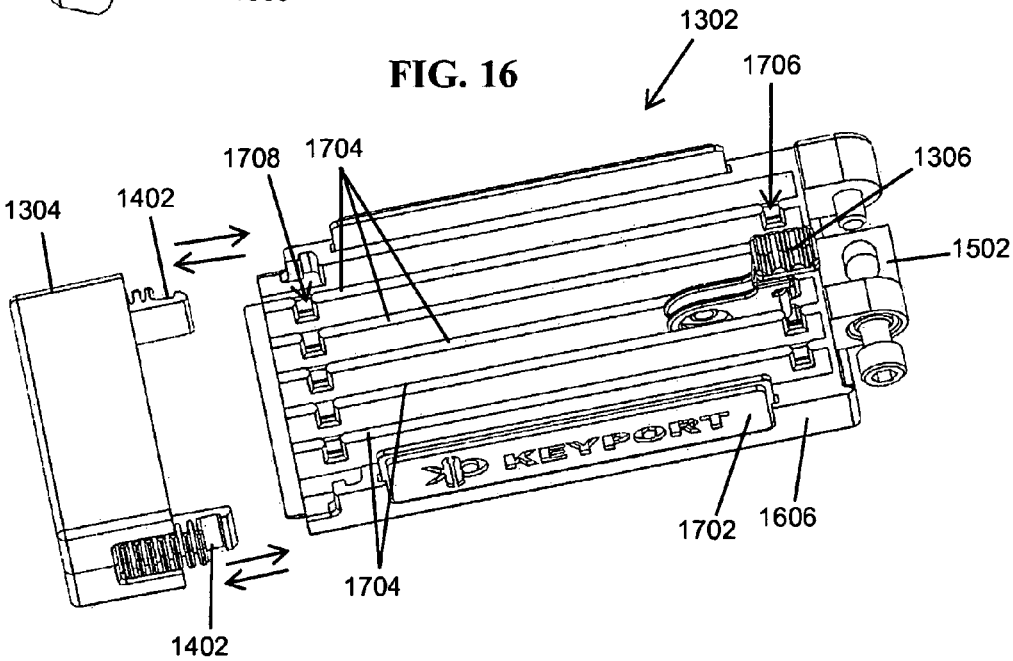
FIG. 17 is a further perspective view showing an example of the key organizing device shown in FIG. 13 illustrating the cover and keys removed, as well as the top portion of the housing of the key organizing device.

FIG. 17 is a further perspective view showing an example of the key organizing device 1300 shown in FIG. 13 illustrating the cover 1304 and key blades 1305 removed, as well as the top portion 1608 of the housing 1302 of the key organizing device 1300. By removing the top portion 1608 of the housing 1302, various parts of the housing cavity 1302 are exposed as well as the position of a sliding mechanism 1306 in the cavity.

Similar to the sliding mechanism 106 in FIG. 1, the sliding mechanism 1306 includes both an actuation device or thumb actuator 1802 (FIG. 18) and a key mount 1605. The thumb actuator 1802 may have a plurality of raised ribs for friction engagement of a thumb or finger to move the sliding mechanism 106 in a longitudinal direction along the housing 1302. Optionally, the thumb actuator 1306, in any example implementation, may include a key identifier (not shown) for identifying the key blade 1305 attached to the respective sliding mechanism 1306. The key identifier may include, as examples, a selected number of raised ribs, a selected number of raised dots, a colored marker, numbers, letters or similar indicia that may be utilize to differentiate keys 1306 housed in the key organizing devices 100, 1300 from one another.

As illustrated in FIG. 17, the cover 1304 may be attached to and removed from the end opening of the housing 1306. The mounting portion or key mount 1605 of the sliding mechanism 1306 is positioned inside the cavity of the housing 1306 and is connected to the thumb actuator 1802 through the sliding mechanism opening 1315. With the cavity of the housing 1302 are guide walls 1704 that, in connection with the longitudinal side wall of the housing 1302 create guide slots in which the key assemblies 1800 (FIG. 18) are positioned. Similar to key organizing devise 100 of FIG. 1, when the key assemblies 1800 are positioned within the guide slots of the housing 1302, the sliding mechanisms 1306 are locked at the far end positions, for example, by recesses 1706, 1708, and then released from those positions to slide the key assemblies 1800 between those positions. The locking and releasing of the key assemblies 1800 can be done any manner that would cause the release of the key assembly 1800 from the locked position when the actuation device or portion 1802 of the sliding mechanism 1306 is depressed. Various examples of such mechanisms are discussed in the specification of PCT/US2007/078960, filed Sep. 19, 2007, which application, including all related drawings, are incorporated by reference in this application.

Figure 18:
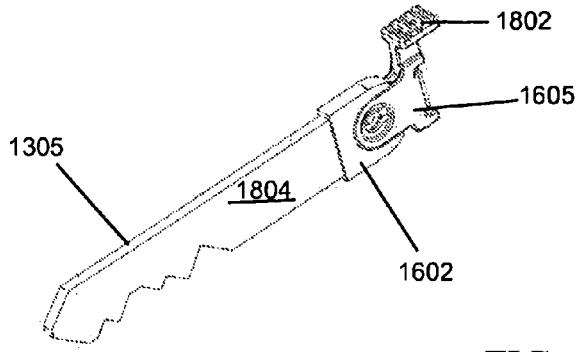
FIG. 18 is a perspective view showing an example of an implementation of a key assembly utilized in connection with the key organizing device of FIG. 13.
Figure 19:
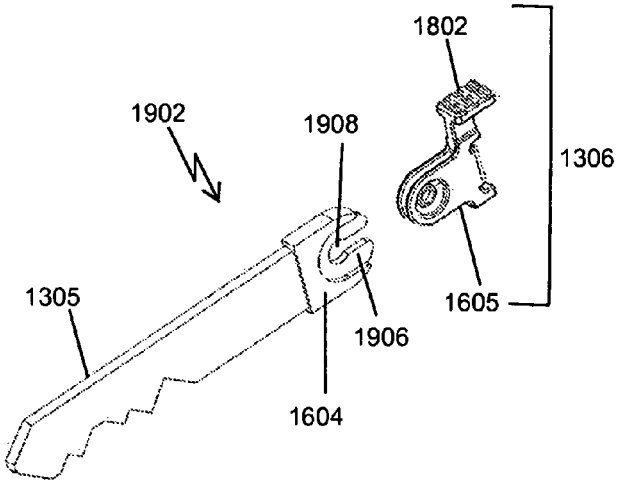
FIG. 19 is an exploded perspective view of the key assembly shown in FIG. 18.

Turning now to FIGS. 18-20, FIGS. 18-20 illustrate one example of a key assembly 1800 that may be utilizing in connection with the key organizing device illustrated in FIG. 13. In particular, FIG. 18 is a perspective view showing an example of an implementation of a key assembly 1800 that may be utilized in connection with the key organizing device 1300 of FIG. 13. FIG. 19 is an exploded perspective view of the key assembly shown in FIG. 18 and FIG. 20 is perspective view of the sliding mechanism of the key assembly showing in FIG. 19.

As illustrated, the key assembly 1800 includes a sliding mechanism 1306, having an actuation portion or thumb actuator 1802 and a mounting portion 1605. The mounting portion 1605 in this example is secured or mounted to a modified key head 1604. The key blade 1305 includes a key blade 1804 and modified key head 1604 connected to the key blade 902. The key head 1605 has a recessed receiving portion 1906 and a slotted opening 1908 for removable engagement with the mounting portion 1605 of the sliding mechanism 1306.

FIG. 20 is perspective view of the sliding mechanism 1306 of the key assembly 1800 showing in FIGS. 18 & 19. As illustrated, the sliding mechanism 1306 includes the thumb actuator 806. The mounting portion 1605 of the sliding mechanism 1306 is positioned below the thumb actuator 806 and separated from the thumb actuator portion 806 by two opposing side ridges 2002. The mounting portion 1605 further includes two opposing parallel retaining side plates 2004, 2006 extending outward from the sliding mechanism 1306 for engagement of the modified key head 1604 just below the opposing side ridges 2002. The retaining side plates 2004, 2006 are spaced apart to create a slot 2008 for snugly receiving and retaining the modified key head 1604. As illustrated, positioned on one side of a retaining side plate 2004, 2006 and extending outward into the slot 2008 is a mounting post 2010. The mounting post 2010 is designed to fit within and through the slotted opening 1908 of the recessed receiving portion 1906 of the key head 1605 to retain the key head 1605 in the mounting portion 1605 of the sliding mechanism 1605.

FIG. 21 is a perspective view of another example of sliding mechanism 2100 that may be utilized in a key assembly 802, 1800 of a key organizing device 100, 1300 such as those illustrated in FIG. 1 and FIG. 13. As illustrated, the sliding mechanism 2100 includes both an actuation portion or thumb actuator 2102 and a mounting portion 2104. The actuation portion 2102 is connected to the mounting portion 2104 via a spring mount 2104. Projected upward from the mounting portion 2104 is a stop 2106 for prevent the thumb actuator 2102 from being depressed beyond a predetermine point. Like the sliding mechanism 1800 in FIGS. 18-20, the mounting portion 2104 includes two opposing parallel retaining side plates 2108, 2110 extending outward from the sliding mechanism 2100 for engagement of a modified key head (not shown), which may be similar in construction to the modified key head 1604 shown in FIG. 19 but with a square construction. The retaining side plates 2108 and 2110 are spaced apart to create a slot 2112 for snugly receiving and retaining the modified key head. As illustrated, positioned on one side of a retaining side plate 2108, 2110 and extending outward into the slot 2112 is a mounting post 2114. The mounting post 2114 is designed to fit within and through a slotted opening (similar to 1908 of FIG. 19) of a key head to retain the key head in the mounting portion 2104 of the sliding mechanism 2100.

Figure 23:
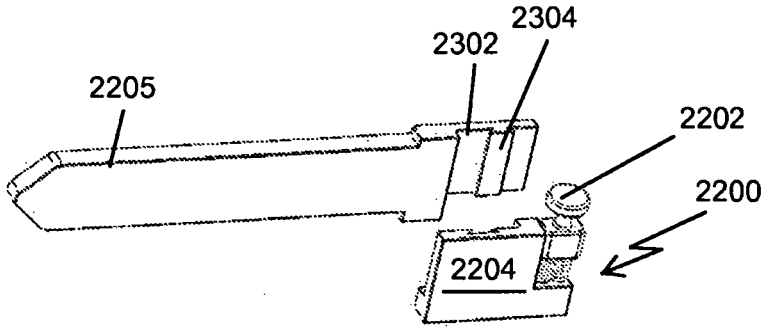
FIG. 23 is an exploded perspective of the key assembly of FIG. 22.

FIGS. 22 & 23 illustrate another example of a key assembly 2206 and may be utilized in connection with a key organizing device of the invention. FIG. 22 is a perspective view of the other example of a key assembly 2206 and FIG. 23 is an exploded perspective of the key assembly 2206 of FIG. 22. In this example, the key 2205 is slideably connected to the sliding mechanism 2220 by a tongue and groove type connection. The sliding mechanism 2220 includes an actuating device 2202 and a mounting portion 2204. The mounting portion 2204 has a recessed portion, for receiving the key head 2302 of the key 2205. The recessed portion includes a groove 2210 for engaging with a tongue portion 2304 on the key head 2304 of the key 2205.

Figure 24:
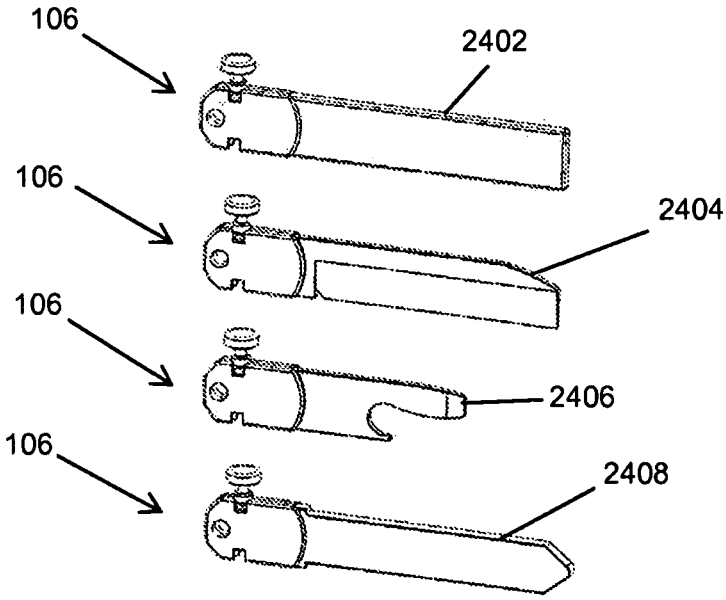
FIG. 24 is an example illustrating other alternatives types of devices being utilizing in connection with the keys assembly.

FIG. 24 is an example illustrating other alternatives types of user devices that may utilized in connection with the key assembly. As illustrated in FIG. 24, a key organizing device similar to the devices 100, 1300 illustrated in FIGS. 1 and 13 may be utilized to housing other alternative user devices, including but not limited to, a USB storage device 2402, a knife 2404, a bottle opener 2406 or a key blank 2408. One end of each of theses alternative user devices may be modified to mount to a sliding mechanism 106, 1306, 2100 or 2200, in the same or similar manner as a key mounts the sliding mechanisms 106, 1306, 2100 or 2200. These devices 2402, 2404, 2406, 2408 may then be housed in the key organizing device 100, 1300 of the invention in the same or similar manner as a key blade 105, 1305.

Figure 25:
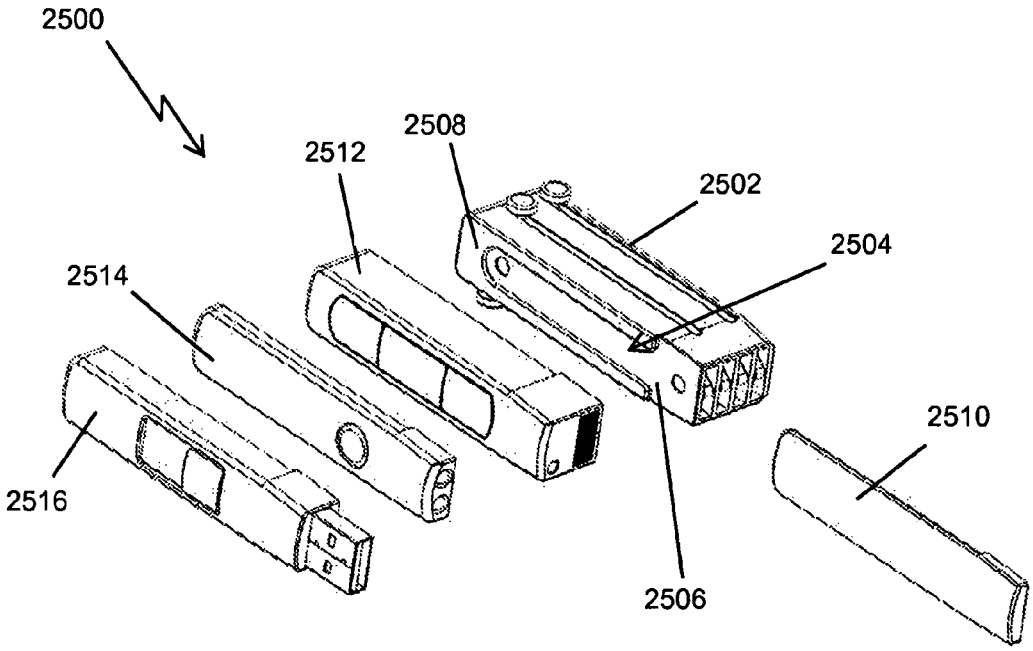
FIG. 25 is an example of an expandable key organizing device.

FIG. 25 is an example of an expandable modular key organizing device 2500. As illustrated, a key organizing device may be designed as an expandable or add-on device. As previously discussed, in one alternative implementation, each key organizing device may house only one key assembly. In this example, each key organizing device could be designed allow the attachment of another key organizing device to one or more of its sides. Thus, the key organizing device may be designed to be an expandable device allowing for the expansion of the device by adding or removing other key organizing devices. Similar in concept, as illustrated in FIGS. 25-31, a key organizing device 2500 may be designed that is expandable to allow a user to not only added on additional key organizing devices, but also assemblies housing other user devices. As illustrated, a key organizer 2500 may be provided that includes a key organizing device having at least one side capable of interchangeably attaching to different assemblies 2512, 2514, 2516 housing devices such as bottle openers, pens, knifes, nail files, laser pointers, whistles, USB devices, alarms, LEDs, radio frequency identification fobs, bar code fobs or other communications devices, digital media players, and similar user devices.

In the illustrated example, housing assembly 2512 may include an alarm, such as a car or home alarm, a radio frequency identification fob, a bar code fob or other similar communications device. Housing assembly 2514 contains an LED, while housing assembly 2516 contains a retractable USB storage device. The key organizer 2502 at one or both sides may include expansion slots 2504 for securely and interchangeably retaining the various housing assemblies 2512, 2514, 2516. When no additional device is desired to be utilized with the key organizer 2502, a slot cover 2510 may be placed over the expansion slot 2504. The illustrated example shows a U-shaped receiving slot 2508 positioned on one side wall 2506 of the key organizer 2502. Those skilled in the art will recognize that a number ways exist to permit the expansion of the key organizer 2502. The invention should not be limited by the illustrated construction receiving slot 2508 construction. For example, other slideably engaging devices may be utilized to retain additional housing members to the key organizer 2502.

Figure 26:
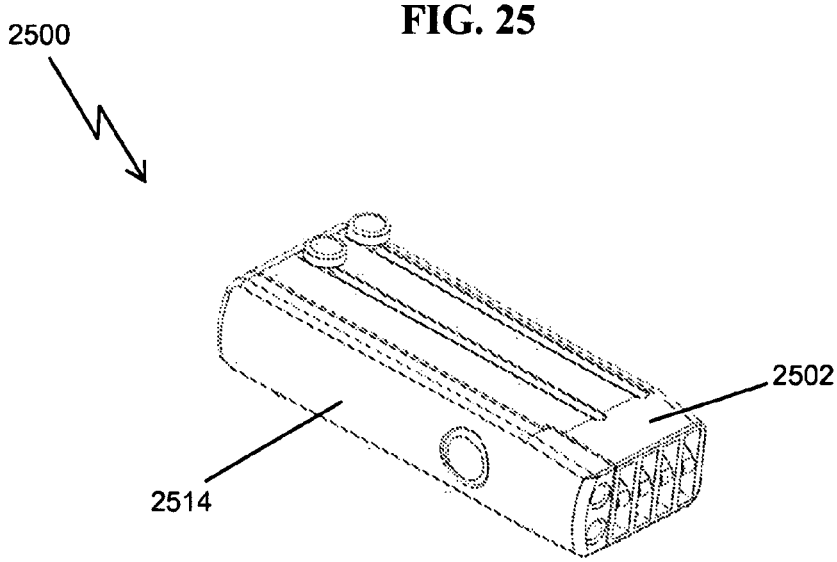
FIG. 26 is an example of an expandable key organizing device retaining an LED light in addition to keys.
Figure 27:
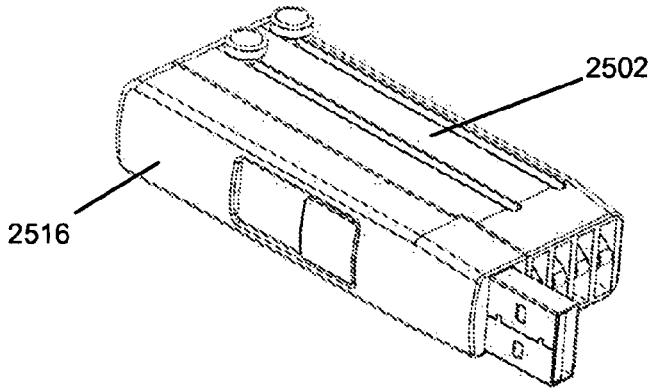
FIG. 27 is an example of an expandable key organizing device retaining a USB drive in addition to keys.
Figure 28:
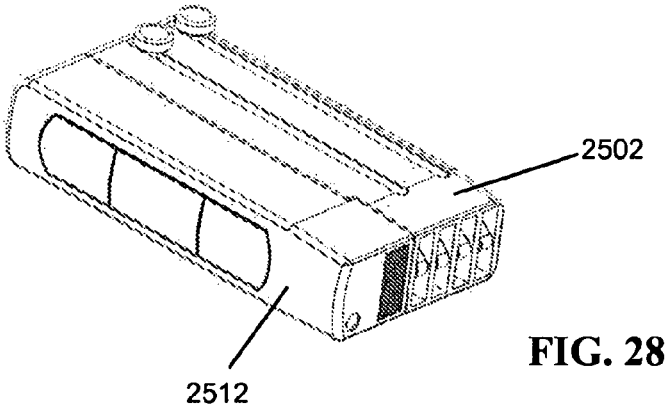
FIG. 28 is an example of an expandable key organizing device retaining an alarm in addition to keys.
Figure 29:
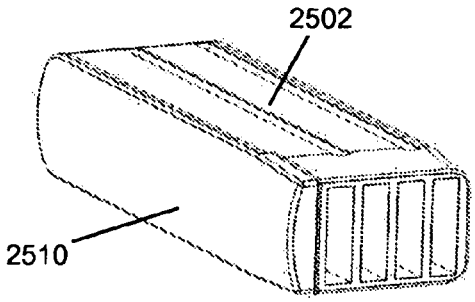
FIG. 29 is an example of an expandable key organizing device retaining a side cover in addition to keys.

By way of example, FIG. 26 illustrates the expandable key organizer 2502 of FIG. 25 having the LED housing assembly 2514 connected thereto. FIG. 27 illustrates the expandable key organizer 2502 of FIG. 25 having the USB housing assembly 2516 connected thereto. FIG. 28 illustrates the expandable key organizer 2502 of FIG. 25 having the alarm/communications housing assembly 2512 connected thereto. FIG. 29 illustrates the expandable key organizer 2502 of FIG. 25 having the slot cover 2510 connected thereto.

Figure 30:
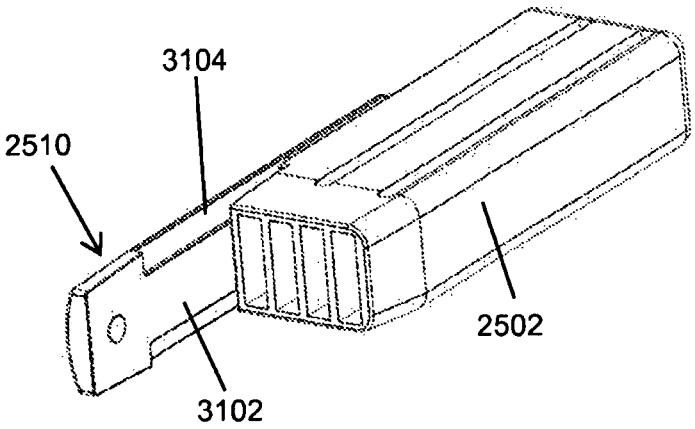
FIG. 30 is an example of an expandable key organizing device illustrating, according to one example implementation, the removal of the side cover of an expandable key organizing device as illustrated in FIG. 29.
Figure 31:
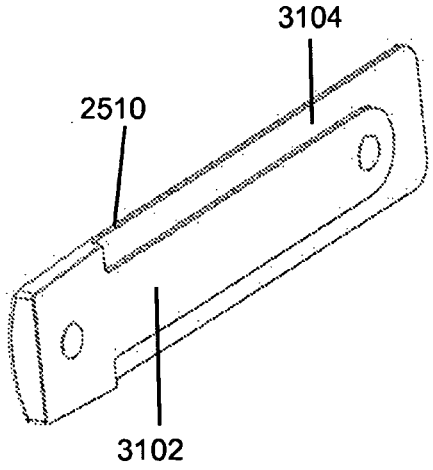
FIG. 31 is a side perspective view of the cover of the expandable key organizing illustrated in FIG. 30.

FIGS. 30 and 31 illustrate in more detail one example of the inclusion of an expandable slot on at least one side of the key organizer 2502. In this example, the slot cover 2510 or add-on housing assembly 2512, 2514, 2516 includes a projection 3102 extending from the side 3104 of the slot cover 2510 or housing assembly 2512, 2514, 2516 designed to engage with the key organizer 2502. The projection 3102 securely fits into the open slot 2508 (FIG. 25) on the side of the key organizer.

While is illustrated that alarms, radio frequency identification fobs, bar code fobs or other communications devices that may be necessary for the operation of a vehicle or use of a key may be included in additional housing assemblies as add-on devices to the key organizing devices, such alarms, radio frequency identification fobs, bar code fobs or other communications devices may be included or embedded in members of the key organizing device. For example, sliding mechanism may be designed with slots or opening for receiving and housing such devices. Further compartments may also be provided in the housing or along the sides of the key organizing devices to house such devices. The inclusion of such devices should not be limited to the inclusion by add-on or expandable features of the key organizing device.

To facilitate the use of keys in connection with the key organizing device of the invention, keys and key blanks may be designed as conventional keys with a modified key head capable of mounting onto a sliding mechanism. Such key heads may then be retained by snap-on key head, caps, crowns or other retaining devices that look and function more like traditional key heads capable of being retained on a key chain and capable of retaining communications devices. FIGS. 32-37 provide two examples of such retaining devices that are constructed to retain the modified key heads for use with the key organizing devices in a manner that permits the keys to be utilized in a traditional sense.

Figure 32:
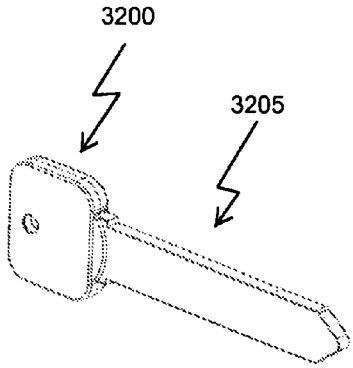
FIG. 32 is perspective view a key design having a removable crown for retaining a key having a modified key head for use in connection with the key organizing device of the invention.
Figure 33:
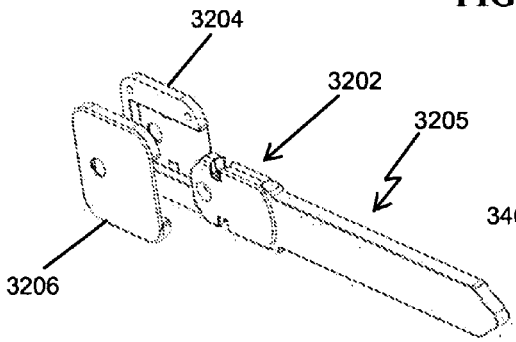
FIG. 33 is an view of the key design of FIG. 32 illustrating the crown of the key removed.
Figure 34:
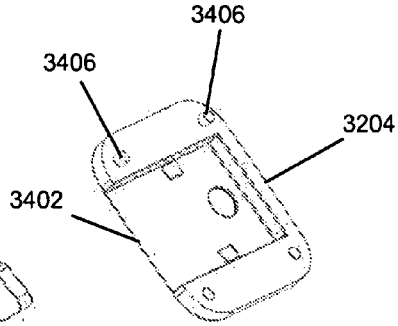
FIG. 34 is perspective view of one opposing crown plate of the key design of FIG. 32.

FIG. 32-34 illustrates one example of a key 3205 for use in a key organizing device of the invention having a crown 3200 attached to the key head 3202 for creating a key structure similar to a traditional key. As illustrated the crown 3200 consists of two opposing, snap together crown plates 3204, 3206 that each have a recess 3402 for receiving and retaining a modified key head 3202 for use in a key organizing device of the invention. Each crown plate 3204, 3206 also includes projections 3406 that snap into aligning female counterparts in the opposing crown plate 3204, 3206 to secure the crown plates 3204 and 3206 to one another. As illustrated, the modified key head 3202 may include the mounting portion of the sliding mechanism to be utilized in a key organizing device of the invention. The crown plates 3204, 3206 may further be designed to fit within indentations or recesses in the key head 3202, such as the recess 3602 (FIG. 36) for receiving the actuation portion or device of the sliding mechanism, to help maintain the key head between the crown plates 3204, 3206.

In the same regarding that crown plates 3204, 3206 may further be designed to fit within indentations or recesses in the key head 3202, such as the recess 3602 (FIG. 36) for receiving the actuation portion or device of the sliding mechanism; other retaining devices may be designed to interface with the modified key head, as it may or may not include the sliding mechanism or mounting portion thereof.

Figure 35:
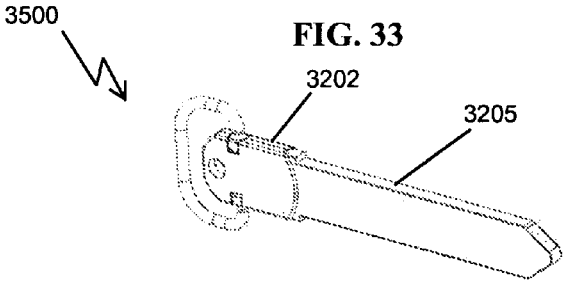
FIG. 35 is perspective view an another key design having a removable retaining device for retaining a key having a modified key head for use in connection with the key organizing device of the invention.
Figure 36:
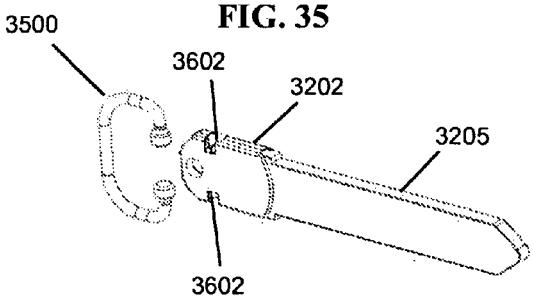
FIG. 36 is a perspective view of the key design of FIG. 35 with the retaining device removed.
Figure 37:
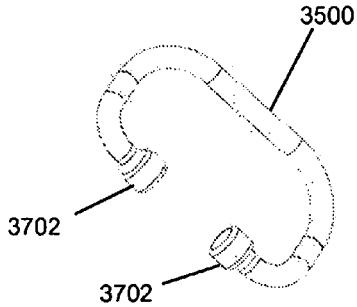
FIG. 37 is a perspective view of the retaining device of FIG. 35.

FIGS. 35-37 show one example of another retaining device 3500 that will permit the keys, as modified, to function like conventional keys. In this example, clamping bar design 3500 is provided that will clamp the upper and lower portions of the key head 3202. The ends of clamp 3500 may include stops 3702 for snuggly fitting within the recesses 3602 of the key head 3202 for receiving the actuation portion of the sliding mechanism.

The key organizing devices 100, 1300 may be fabricated from materials selected for suitable durability, functionality and appearance of the key organizing devices 100. For example, the housing 102, 1302 may be formed of a plastic, metal, or graphite material. As a plastic material, Lustran® 248 acrylonitrile-butadiene-styrene ("ABS") may for example be utilized in forming the housings 102, 1302. In the case of key organizing device 100, the housing sleeve 115 may be also constructed of the same material. An indicia plate may be formed of the same material selected for the housing 102, 1302. Where the cover 104, 1304 of a key organizing device 100, 1300 includes tabs, the cover may be formed of a flexible material such as a plastic composition. Likewise, where the housing of a key organizing device includes tabs, the housing may be formed of a flexible material such as a plastic composition. Where the cover 104 or housing 102 does not include tabs then that cover 104 may instead be formed of a minimally-flexible material such as a metal composition. As an example of a metal composition, aluminum alloy 380 may be die-cast and utilized. The sliding mechanisms may be formed, for example, from a flexible material such as a plastic composition. As an example, DuPont Delrin 100T® may be utilized. The keys may, for example, be formed of a metal alloy. CDA 353 brass is an example of a suitable metal alloy for forming key blades 105, 1305. A sliding mechanism dampener in a key organizing device may be formed from a material having suitable flexibility and durability for frequent deformation as sliding mechanisms are deployed. For example, a polyurethane foam may be utilized in forming a sliding mechanism dampener. A key dampener in a key organizing device may be formed from a material having suitable flexibility and durability for frequent sliding engagement with keys as sliding mechanisms are deployed. As an example, Poron Quick-Recovery super-resilient open cell polyurethane foam, having a firmness of 8-14 pounds per square inch, a density of 15 pounds per cubic foot, a 100% stretch limit, and a tensile strength of 80 pounds per square inch may be utilized. Pins in sliding mechanisms may be formed, for example, of a metal alloy such as 303 stainless steel. Exterior surfaces of key organizing devices may have decorative surfaces, such as multiple-colored first and second housing elements, for example.

Dimensions for the key organizing devices and keys may be selected consistent with factors including utility and portability, as well as standardization. For example, key organizing devices may be selected to hold six (6) keys, including three (3) keys having thumb actuators exposed outside each of first and second housing elements. Key organizing devices configured with other arrangements of thumb actuators and configured for holding different quantities of keys may also be fabricated. For example, a key organizing device configured for holding six (6) keys may have overall dimensions including a width of about 1.17 inches, a height of about 0.67 inches, and a length of about 2.75 inches. Key slots may be, for example, about 1.0 inch tall and about 0.45 inch wide. Keys may, for example, be standardized with blades having a thickness within a range of between about 0.07 inch and about 0.10 inch, key heads 1002 having a width of about 0.44 inch, and key head edges having a thickness of about 0.1 inch. Keys and key organizing devices may be mutually configured, for example, to provide a standardized deployment length for a key blade in an extended position, such as about 1.9 inches. A key blade deployment length of 1.9 inches may provide at least about one-eighth of an inch of clearance between the key organizing device and a lock (not shown) when a key is in use, to prevent scratching of the lock.

Keys may be configured for a wide variety of types of end-utilization, for example as keys for a vehicle, mailbox, deadbolt, house, office, or security lock. The key organizing device may, for example, be utilized for holding a plurality of end-user selected keys or other implements configured for attachment into the key organizing device, such as a bottle opener, pen, knife, file, radio frequency identification fob, or bar code fob. Likewise, the keys may be configured for end-utilization in a wide variety of types of locks, or for holding non-key implements. While the foregoing description refers in some instances to the key organizing devices, and the keys as shown in the figures, it is appreciated that the subject matter is not limited to these structures, or limited to the structures discussed in the specification. Other shapes and configurations of key organizing devices and keys may be fabricated. In summary, the key organizing device of the invention provides a key blank to which keys may be constructed that removes a significant portion of a traditional key head. This modified key head design may be designed as a one-size-fits-all head, resulting in a shorter, thinner key blank. Such modified key head design may also be applied to numerous other user devices to provide a suite of modular devices to consolidate multiple keys, key fobs, and accessories into a single more streamlined access tool.

Snap-on key heads or crowns may be utilized to transform the modified key blade and head into a traditional key form, allowing them the modified key heads and blades to be easily placed back onto a key chain. The crowns may provide a uniform look and size to all such keys, along with the ability to color code and label each crown to distinguish keys from one another. Crowns may be useful for providing valets keys and for loaning a single key from a key organizing device of the invention for use by another.

The key organizing device of the invention may be designed to maintain one or more keys in the housing of the device. In the illustrated examples in FIGS. 1 and 13, a 6-port personal access device that consolidates up to six keys is provided, while the organizing device illustrated in FIG. 25 is designed as an expandable device having a 4-port base device for maintaining up to four keys, further including a side expansion slot for adding additional organizational housing devices. As illustrated and described above, those skilled in the art will recognize that design and construction of the key organizing device of the invention may be compatible with all standard keys and may provide for the labeling of keys for ease of identification and initial setup. The key organizing device further protects user by enclosing the keys and protecting user from the potential of keys to slice, cut, or stab a user while in a user's pocket. The keys containing the key organizing device may be accessed without looking or searching through each individual key to find the right one and can be easily engaged with only one hand. As described above, the key organizing device may be constructed of high grade materials such as nylon infused plastic and magnesium. The key organizing devices may further be designed to include serial numbers, which if lost, can be utilized to reunited with the devices with their owners.

Moreover, it will be understood that the foregoing description of numerous examples has been presented for purposes of illustration and description. This description is not exhaustive and does not limit the claimed invention to the precise forms disclosed. Modifications and variations are possible in light of the above description or may be acquired from practicing the invention. The claims and their equivalents define the scope of the invention.

What is claimed is:

1. A modified key comprising:

an elongated member having a key blade portion and terminating at a mount receiving portion;

a mounting device that comprises a recess and is attached to the mount receiving portion to form a modified key head; and a spring-loaded pin assembly that comprises a head, a pin, a spring, and a stop mechanism, wherein:

the head of the spring-loaded pin assembly is directly attached to the pin, the stop mechanism is positioned along the pin at a predetermined distance under the head of the spring-loaded pin assembly and is configured to prevent movement of the modified key, the pin is configured to receive the spring thereon under the stop mechanism, the pin and the spring are retained in the recess, and the modified key is configured such that when the head of the spring-loaded pin assembly is depressed the entire stop mechanism moves downward toward the modified key head.

2. The modified key of claim 1 wherein the mounting device is permanently affixed to the mount receiving portion.

3. The modified key of claim 1 wherein the mounting device is removable from the key blade portion and wherein the mount receiving portion has a recessed end for receiving the mounting device.

4. The modified key of claim 1 wherein the modified key head includes an opening permitting the modified key to be retained on a key chain.

5. The modified key of claim 1 wherein the mounting device is formed integral with the elongated member.

6. The modified key of claim 1 wherein the mounting device further comprises two opposing side retaining plates, each of the side retaining plates comprising a front portion and a back portion separated by the recess.

7. A method of making a modified key, comprising:

fabricating an elongated member having a key blade portion and terminating at a mount receiving portion;

attaching a mounting device, that comprises a recess, to the mount receiving portion to form a modified key head; and attaching a spring-loaded pin assembly that comprises a head, a pin, a spring, and a stop mechanism, wherein:

the head of the spring-loaded pin assembly is directly attached to the pin, the stop mechanism is positioned along the pin at a predetermined distance under the head of the spring-loaded pin assembly and is configured to prevent movement of the modified key, the pin is configured to receive the spring thereon under the stop mechanism, the pin and the spring are retained in the recess, and the modified key is configured such that when the head of the spring-loaded pin assembly is depressed the entire stop mechanism moves downward toward the modified key head.

8. The method of claim 7 wherein the attaching of the mounting device to the mount receiving portion comprises permanently affixing the mounting device to the mount receiving portion.

9. The method of claim 7 wherein the attaching of the mounting device to the mount receiving portion comprises removably affixing the mounting device to the key blade portion and wherein the mount receiving portion has a recessed end for receiving the mounting device.

10. The method of claim 7 wherein the modified key head includes an opening permitting the modified key to be retained on a key chain.

11. The method of claim 7 wherein the attaching of the mounting device to the mount receiving portion comprises integrally forming the mounting device with the elongated member.

12. The method of claim 7 wherein the mounting device further comprises two opposing side retaining plates, each of the side retaining plates comprising a front portion and a back portion separated by the recess.

* * * * *

UNITED STATES PATENT AND TRADEMARK OFFICE

CERTIFICATE OF CORRECTION

PATENT NO. : 8,485,007 B2
APPLICATION NO. : 12/808358
DATED : July 16, 2013
INVENTOR(S) : Josh Downes It is certified that error appears in the above-identified patent and that said Letters Patent is hereby corrected as shown below:

Title page, Item (73), the Assignee "Keypoint, Inc." should read --Keyport, Inc.--

In the Specification

Column 7, line 9, before the text beginning "The housing 102 may", insert the following paragraph:

--As illustrated, the housing 102 has three sliding mechanism openings 115 on the top side and three sliding mechanism openings 115 on the bottom side (not shown). The sliding mechanism openings 115 are slots have generally parallel sides and opposing end holes 814, 816. As will be further illustrated in FIGS. 9-11, the pin portion 1004 of the pin assembly includes a stop mechanism 1002 (FIG. 10) that fits snugly in the opposing end holes 814, 816 to prevent the sliding mechanisms 106 from moving. When the head 1005 of the pin assembly is depressed, by applying pressure to the pin assembly, the stop mechanism 1002 is moved downward and into the cavity of the housing 102, thereby moving the stop mechanism 1002 out of the respective end hole 814, 816. Moving the stop mechanism 1002 out of the respective end hole 814, 816 disengages the sliding mechanism 106 and allows it to move longitudinally along the housing 102 to retract or extend the key blades 105.--

Signed and Sealed this
Seventh Day of October, 2014

Michelle K. Lee

Michelle K. Lee
*Deputy Director of the United States Patent and Trademark Office*